US008726805B2

(12) United States Patent
Stöhr et al.

(10) Patent No.: US 8,726,805 B2
(45) Date of Patent: May 20, 2014

(54) LETTERPRESS PRINTING MACHINE

(75) Inventors: Manfred Georg Stöhr, Güntersleben (DE); Ernst Kühn, Zell am Main (DE); Volkmar Rolf Schwitzky, Würzburg (DE); Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 919 days.

(21) Appl. No.: 11/921,492

(22) PCT Filed: May 23, 2006

(86) PCT No.: PCT/IB2006/051651

§ 371 (c)(1),
(2), (4) Date: Nov. 30, 2007

(87) PCT Pub. No.: WO2006/129245

PCT Pub. Date: Dec. 7, 2006

(65) Prior Publication Data

US 2009/0101030 A1 Apr. 23, 2009

(30) Foreign Application Priority Data

Jun. 1, 2005 (EP) ..... 05405363

(51) Int. Cl.

*B41F 5/02* (2006.01)
*B41F 5/04* (2006.01)
*B41M 1/02* (2006.01)

(52) U.S. Cl.

CPC ... *B41F 5/02* (2013.01); *B41F 5/04* (2013.01); *B41M 1/02* (2013.01)
USPC ..... 101/72; 101/91; 101/349.1

(58) Field of Classification Search

CPC ..... B41F 5/02; B41F 5/04; B41F 5/06; B41F 5/08; B41F 5/10; B41F 5/12; B41F 5/14; B41F 5/16; B41F 5/18; B41M 1/02; B41M 1/04
USPC ..... 101/72–77, 350.4, 349.1, 91
See application file for complete search history.

(56) References Cited

U.S. PATENT DOCUMENTS 4,231,291 A * 11/1980 Davidson, Jr. ..... 101/137
4,413,560 A 11/1983 Rogge (Continued)

FOREIGN PATENT DOCUMENTS

DE 1486894 2/1966
DE 3047390 12/1980

(Continued)

OTHER PUBLICATIONS

"Letterpress printing", pp. 395-408 of the Handbook of Print Media (H. Kipphan, ISBN 3-540-67326-1).

*Primary Examiner* — David Banh
(74) *Attorney, Agent, or Firm* — Krieg DeVault LLP; Clifford W. Browning

(57) ABSTRACT

The letterpress printing machine includes an impression cylinder (8), at least one inking device (11, 12, 13) with an inking train comprising inking rollers (25, 26, 28) and at least one letterpress form cylinder (14, 15, 16) inked by said at least one inking device (11, 12, 13). The at least one letterpress form cylinder (14, 15, 16) is driven by first drive means (30), whereas the at least one inking device (11, 12, 13) is driven by second drive means (31, 32, 33), the second drive means (31, 32, 33) being mechanically independent from the first drive means (30). A control unit is coupled to the second drive means (31, 32, 33) to adjust a circumferential speed of the inking rollers (25, 26, 28) with respect to a circumferential speed of the letterpress form cylinder (14, 15, 16) so as to adjust deposition of ink by the inking device (11, 12, 13) on the letterpress form cylinder (14, 15, 16). At least one of letterpress form (14, 15, 16) cylinder is preferably a numbering cylinder for numbering printed sheets or webs.

26 Claims, 2 Drawing Sheets

(56) References Cited

U.S. PATENT DOCUMENTS

| | | | | |
|---|---|---|---|---|
| 4,566,384 | A * | 1/1986 | Matsumoto | 101/170 |
| 5,069,124 | A * | 12/1991 | Schneider | 101/142 |
| 5,136,942 | A | 8/1992 | Germann | |
| 5,413,038 | A | 5/1995 | Josl-Enneking et al. | |
| 5,590,599 | A * | 1/1997 | Muller et al. | 101/483 |
| 5,826,505 | A * | 10/1998 | Volz et al. | 101/183 |
| 6,006,664 | A | 12/1999 | Hummel et al. | |
| 6,050,188 | A | 4/2000 | Bolza-Schunemann | |
| 6,378,427 | B1 * | 4/2002 | Endisch | 101/349.1 |
| 6,408,748 | B1 * | 6/2002 | Hajek et al. | 101/177 |
| 6,668,718 | B2 * | 12/2003 | van den Brink et al. | 101/216 |
| 7,100,507 | B1 * | 9/2006 | Rochon et al. | 101/483 |
| 7,216,583 | B2 | 5/2007 | Schaede | |
| 7,475,634 | B2 * | 1/2009 | Barrois et al. | 101/349.1 |
| 2002/0014172 | A1 * | 2/2002 | Fujiwara et al. | 101/350.3 |
| 2002/0035942 | A1 * | 3/2002 | Reinhard et al. | 101/484 |
| 2002/0088356 | A1 * | 7/2002 | Van Den Brink et al. | 101/219 |
| 2002/0185025 | A1 * | 12/2002 | Dufour et al. | 101/335 |
| 2003/0056674 | A1 * | 3/2003 | Callahan et al. | 101/484 |
| 2003/0230206 | A1 * | 12/2003 | Ruoff | 101/216 |
| 2004/0011230 | A1 * | 1/2004 | Schneider et al. | 101/217 |
| 2004/0050272 | A1 * | 3/2004 | Detmers et al. | 101/216 |
| 2004/0103803 | A1 * | 6/2004 | Price et al. | 101/350.5 |
| 2004/0187720 | A1 * | 9/2004 | Naniwa et al. | 101/457 |
| 2004/0261643 | A1 * | 12/2004 | Niemiro | 101/479 |
| 2005/0120901 | A1 * | 6/2005 | Albrecht et al. | 101/480 |
| 2005/0183598 | A1 * | 8/2005 | Johnson et al. | 101/423 |
| 2007/0012207 | A1 * | 1/2007 | Takenouchi et al. | 101/335 |

FOREIGN PATENT DOCUMENTS

| | | | |
|---|---|---|---|
| DE | 8401569 | | 1/1984 |
| DE | 3618488 | | 6/1986 |
| EP | 0061795 | | 3/1982 |
| EP | 0167196 | | 6/1985 |
| EP | 0718112 | | 9/1995 |
| EP | 0818309 | | 6/1997 |
| GB | 1065727 | | 4/1967 |
| JP | 59073952 | A | 4/1984 |
| JP | 62056147 | A | 3/1987 |
| JP | 2171245 | A | 7/1990 |
| JP | 10067095 | A | 3/1998 |
| JP | 2000085095 | A | 3/2000 |

* cited by examiner

LETTERPRESS PRINTING MACHINE

This application claims the benefits under 35 U.S.C. 119 (a)-(d) or (b), or 365(b)of International Application No. PCT/IB2006/051651 filed May 23, 2006, and European Patent Application No. 05405363.2 filed Jun. 1, 2005.

TECHNICAL FIELD

The present invention generally relates to a letterpress printing machine, and more specifically to a letterpress numbering machine.

BACKGROUND OF THE INVENTION

Letterpress printing is a well-known printing process by which a rigid printing forme comprising raised portions corresponding to the pattern to be printed is inked with a relatively viscous, pasty ink, the inked pattern being thereafter applied to the paper either directly by contacting the paper and the inked printing forme or indirectly by first inking a transfer medium (or blanket) and thereafter applying this transfer medium to the paper.

Letterpress printing is to be distinguished from flexography (which printing process also falls under the category of relief printing). Unlike letterpress printing, flexography uses low viscosity inks and resilient or soft, flexible printing plates, and the pressure applied between plate cylinder and substrate is low (one commonly refers to "kiss printing" in that respect). The reader may refer to chapter 2.3 entitled "Letterpress printing", pp. 395-408 of the Handbook of Print Media (H. Kipphan, ISBN 3-540-67326-1) for further details about letterpress printing and flexography. Flexographic printing machines are for instance disclosed in DE 29 41 521, DE 43 08 492 and EP 0 818 309.

Sheet-fed or web-fed letterpress printing machines are known in the art, among others in the field of printing of securities such as banknotes and other similar valuable documents. These machines commonly comprise a letterpress forme cylinder carrying at least one rigid letterpress printing forme having reliefs corresponding to the coloured zones to be printed, an impression cylinder which cooperates with the said forme cylinder, and an inking system for inking the forme cylinder.

In the field of security printing, letterpress printing is especially applied for the numbering of banknotes or similar valuable documents. Numbering machines for the numbering of banknotes or other valuable documents are for instance known from DE 1 486 894 and EP 0 061 795. In such numbering machines, the forme cylinder is designed as a numbering cylinder which commonly comprises a main shaft carrying a plurality of supporting discs each bearing a plurality of numbering boxes. Each numbering box typically consists of a plurality of individually rotatable numbering wheels disposed parallel to one another on a common shaft, each numbering disc comprising at its periphery a plurality of letterpress printing patterns representing alphanumeric characters or symbols. A switching mechanism is further provided to switch selected ones of the numbering wheels of each numbering box following each printing operation so that a unique alphanumeric sequence (or "serial number") is formed by each numbering box and can be applied to a corresponding location on the printed sheets or webs. In the above numbering machines, the inking system associated to the numbering cylinder inks the surface of the various numbering wheels of each numbering box and this inked surface is applied to the printed sheets or webs to be numbered. Other examples of numbering machines and/or numbering boxes for such numbering machines are further described in DE 30 47 390, DE 36 18 488, EP 0 167 196, EP 0 718 112 and WO 2004/016433.

The above printing machines are commonly equipped with a main drive comprising a single motor. The cylinders and rollers of the printing machine are driven by means of this motor, through a system of gear wheels, pinions and/or belts, generally located on a lateral part of the machine, the so-called "drive side". Thus the rotation of all the rollers and cylinders are synchronised. In particular, the circumferential speed of the letterpress forme cylinder or cylinders is the same as that of the various rollers of the inking system. The use of a single motor and a common gear drive system for driving all cylinders and rollers of the printing machine is accepted as a general rule in this field for avoiding all synchronisation problems.

Use of separate drives has been proposed in the context of flexographic printing machines. European patent application EP 0 818 309 for instance discloses a flexographic printing machine with three separate drives for driving respectively the inking rollers, the flexographic plate cylinders and the impression cylinder. The flexographic plate cylinders are coupled to a common drive via so-called Schmidt-couplings (or parallelogram couplings) enabling compensation of axis offsets and use of a single set of gear wheels for varying plate cylinder diameters. While separate drives are used, these drives are nevertheless controlled in such a manner that the circumferential speed of the inking rollers and flexographic plate cylinders matches that of the impression cylinder. In that respect, driving of the rollers and cylinders is also made in synchronism as in the case of a single drive.

A particularity of letterpress printing, especially letterpress printing in rotary printing machines, resides in the fact that the inking of the letterpress printing forme is not perfectly homogeneous. In particular, there is a tendency for ink to accumulate on the edge of the raised patterns of the letterpress printing forme, especially on the sides of the raised patterns which are oriented in or opposite the rotational direction of the letterpress forme cylinder (i.e. perpendicularly to the axis of rotation of the forme cylinder). As a result, the printed pattern is not perfectly homogeneous and tends to create a sort of shadow effect on one side of the printed pattern where ink has accumulated, which can be a problem in terms of printing quality. Inks which accumulates on the sides of the raised portions of the letterpress printing forme thus has to be wiped away by periodically cleaning the letterpress printing forme, which cleaning process inevitably takes some time and negatively affects the production efficiency.

A further problem resides in the fact that disassembling and mounting of the rollers of the inking system for cleaning or replacement purposes is tedious and requires disconnecting and connecting, respectively, the gear drives that couples the inking system to the other rotating parts of the printing machine.

SUMMARY OF THE INVENTION

It is therefore an aim of the present invention to improve the known machines.

A particular aim of the present invention is to improve preciseness of the inking of the letterpress forme cylinder.

A further particular aim is to render maintenance of such printing machines easier.

These aims are attained by virtue of a specific drive in the inking system and control unit coupled to said drive for adjusting the circumferential speed of the inking rollers of the inking system with respect to the circumferential speed of the inked letterpress printing form.

Thus, an object of the present invention is a sheet-fed or web-fed letterpress printing machine, comprising an impression cylinder, at least one inking device with an inking train comprising rollers, and at least one letterpress forme cylinder inked by said at least one inking device, wherein said letterpress forme cylinder is driven by first drive means, wherein said inking device is driven by second drive means, said second drive means being mechanically independent from said first drive means, and wherein a control unit is coupled to said second drive means to adjust a circumferential speed of said inking rollers with respect to a circumferential speed of said letterpress forme cylinder so as to adjust deposition of ink by said inking device on said letterpress forme cylinder.

Advantageous embodiments of the invention are the subject-matter of the dependent claims.

BRIEF DESCRIPTION OF THE DRAWINGS

An embodiment of a numbering machine, according to the invention, will now be described with reference to the drawings in which.

EMBODIMENTS OF THE INVENTION

The invention will be described in connection with an example of a sheet-fed numbering machine for numbering sheets carrying banknotes. It shall however be understood that the invention is not limited to sheet-fed printing machines and is equally applicable to web-fed printing machines. Similarly, the invention is applicable to letterpress printing machines in general, or any printing machine which makes use, at least partly, of a letterpress printing forme.

Figure 1:
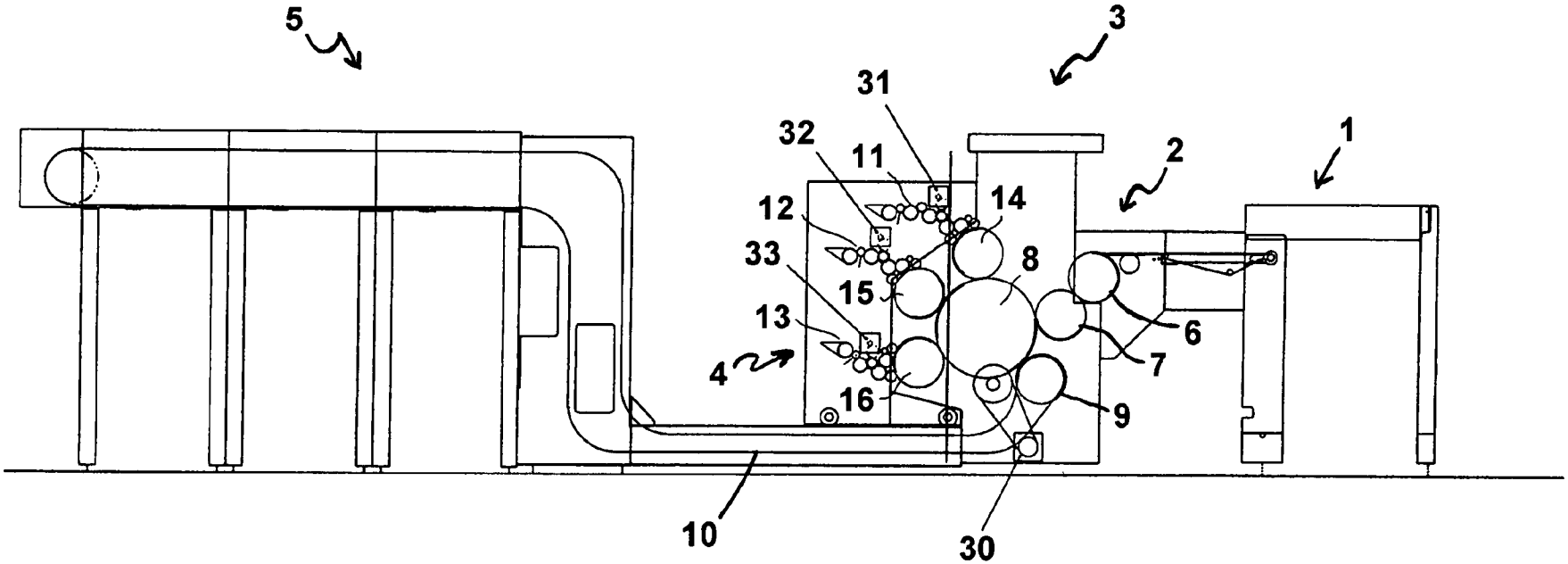
FIG. 1 is a schematic side view of the machine.

FIG. 1 shows a sheet-fed numbering machine assembly comprised of several units. The sheets which have previously been provided with a given number of prints arranged in matrix form and that shall be numbered are stored in a sheet feeder generally designated by 1. The sheets pass over the sheet feed table 2 and are transferred to a printing unit 3, by means of transfer cylinders 6 and 7. The sheets are taken up from transfer cylinder 7 by an impression cylinder 8 which cooperates with, in this example, three letterpress forme cylinders 14, 15, 16 (cylinder 14 being optional) distributed around the impression cylinder 8. In this particular example, impression cylinder 8 is a two-segment cylinder, i.e. it can simultaneously carry two successive sheets on its periphery, the diameter of impression cylinder 8 being approximately twice that of the forme cylinders 14, 15, 16.

Sheets which are carried by the impression cylinder 8 are printed by the various letterpress forme cylinders 14, 15, 16 and thereafter delivered to a chain wheel drum 9 where the numbered sheets are transferred to a chain gripper system 10 which transports the sheets to a delivery unit 5. The construction of units 1, 2, 3, 5 and 10 is familiar to those skilled in the art and does not need a detailed description.

In this example, the three letterpress forme cylinders 14, 15, 16 arranged around the impression cylinder 8 are constructed respectively as a plate cylinder 14 and two numbering cylinders 15, 16 which contact the impression cylinder 8 creating three successive printing nips. Plate cylinder 14 carries, as is common in the art, a letterpress printing plate for applying a pattern which does not need to be changed too frequently (such as the signature of a the director of the national bank issuing the banknotes) while the remaining two numbering cylinders 15, 16 are used for applying serial numbers onto the banknotes (the same serial number is typically printed twice on each banknote). This specific example shall not be regarded as limiting. For instance, numbering cylinder 15 may be replaced by a plate cylinder similar to plate cylinder 14 to apply specific patterns such as signatures, etc.

As already mentioned hereinabove, numbering cylinders are already well-known in the art and do not need to be described here in detail. One may for instance refer to documents DE 1 486 894, EP 0 061 795, DE 30 47 390, EP 0 167 196, EP 0 718 112 and WO 2004/016433 for a more detailed description of such numbering cylinders.

Within the scope of the present invention, it suffice to understand that a numbering cylinder commonly comprises a shaft with a plurality of supporting discs which each carry a plurality of numbering boxes that are arranged to come into contact with the surface of the sheets carried by the impression cylinder.

Transfer cylinders 6 and 7, impression cylinder 8, chain wheel drum 9 and cylinders 14, 15,16 are all driven by a common driving source, namely main drive motor 30, through a gear wheel and/or belt driving arrangement (not shown) so that their rotations are synchronised.

Each cylinder 14, 15 and 16 receives ink from an associated inking device 11, 12 and 13 respectively. As may be seen from FIG. 2, in the embodiment as shown, each cylinder is contacted and inked by a corresponding inking train comprising a plurality of inking rollers as is common in the art. In the example shown, the inking trains each comprise, starting from the ink fountain with its fountain roller 20, a vibrator roller 21, a first distribution roller 22, a first transfer roller 23, a second distribution roller 24, first and second inking rollers 25, 26 and, optionally, a second transfer roller 27 and a third inking roller 28. The inking train of the first inking device 11 is slightly longer than the two others and further comprises an additional pair of transfer rollers 29 which are interposed between the vibrator roller 21 and the first distribution roller 22. This is intended to bring the ink fountain of the first inking device 11 further back to where the ink fountains of the other two inking devices 12, 13 are located.

The purpose of the vibrator roller 21 is to transfer an ink stripe from the fountain roller 20 to the subsequent roller in the inking train (namely transfer roller 29 in the case of the first inking device 11 or first distribution roller 22 in the case of the second and third inking devices 12, 13). First and second distribution rollers 22 and 24 ensure, on the other hand, the lateral distribution of the ink, both distribution rollers being subjected to a reciprocating lateral movement. The three inking rollers 25, 26 and 28 contact the surface of the cylinders 14, 15, 16 (or more precisely the surface of the letterpress plate of cylinder 14 and the surface of the various numbering wheels of the numbering boxes located on the periphery of the numbering cylinders 15, 16) and transfer the appropriate amount of ink thereupon. The construction of inking trains is as such familiar to those skilled in the art and does not need a further detailed description.

Figure 2:
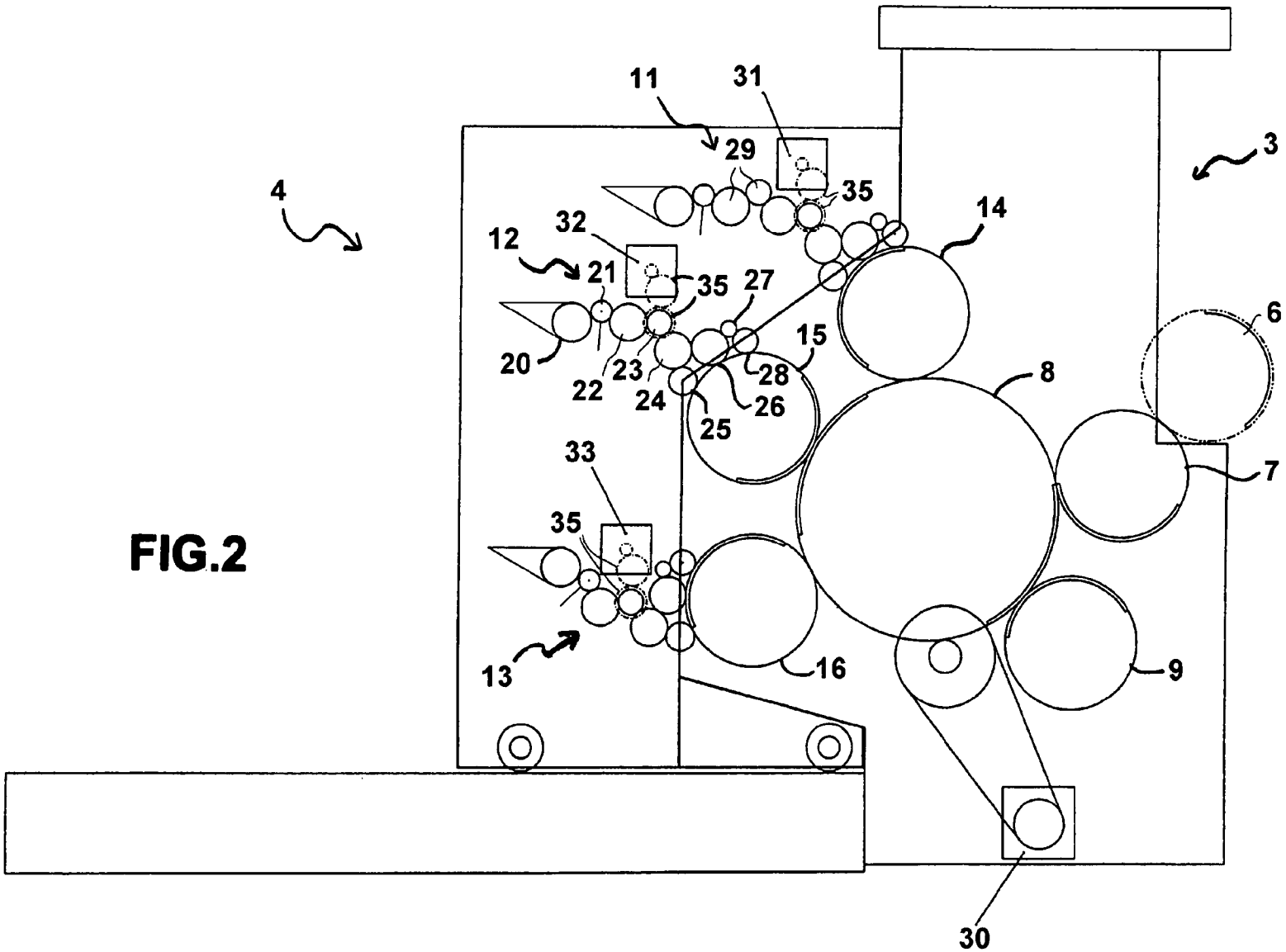
FIG. 2 is an enlarged view of the machine of FIG. 1.

As schematically illustrated in the figures, each inking unit 11, 12 and 13 is furthermore provided with an independent driving source 31, 32 and 33 respectively, which drives the aforementioned inking rollers of the inking trains through a gear drive arrangement which is symbolised on FIG. 2 by circles 35 in dashed lines. Driving of the inking rollers of the inking train is ensured either directly through the gear drive arrangement or indirectly through friction with neighbouring rollers. In this particular example, each driving source 31, 32, 33 is coupled to some of the rollers of the corresponding inking train through the corresponding gear drive arrangement 35, the other rollers being driven by friction. The driving sources 31, 32, 33 are preferably and advantageously electric motors having a power sufficient for driving the rollers of the inking train of each inking device. Suitable servo-motors are commercially available.

A control unit (not shown in the drawings) coupled to the driving sources 31, 32, 33 may be provided to adjust the driving speed of each driving source 31, 32, 33 with respect to that of the main driving source 30. More particularly, by adjusting the driving speed of the driving sources 31, 32, 33, one can act on the circumferential speed of the various inking rollers 25, 26, 28 and adjust this circumferential speed with respect to the circumferential speed of the cylinders 14, 15, 16. The circumferential speed of the inking rollers 25, 26, 28 can in particular be adjusted to be higher or lower than that of the cylinders so that accumulation of ink on the edges of the raised printing portions of the letterpress printing formes (in this case, the raised portions on the numbering wheels of the various numbering boxes) can be counteracted (or even prevented) to thereby diminish the shadowing effect mentioned in the preamble. Conversely, the circumferential speed of the inking rollers 25, 26, 28 may be adjusted so as to exacerbate the shadowing effect, i.e. increase accumulation of ink on the edge of the raised portions of the printing formes. Indeed, this shadowing effect may be exploited to create a kind of security feature.

As schematically illustrated, the three inking devices 11, 12, 13 are preferably and advantageously mounted in a common mobile carriage 4. The mobile carriage 4 is movable on rails in this example, but could be suspended if appropriate. This arrangement is advantageous since it permits easy disassembly of the inking devices 11, 12, 13 from the printing unit 3 for maintenance purposes. It shall be appreciated that the absence of any gear drive between the inking devices 11, 12, 13 and the remaining rotating parts of the printing unit 3 renders this operation quick and easy to perform. In addition, this particular construction enables a direct access to the various forme cylinders, thereby facilitating maintenance and replacement operations on these cylinders. This is particularly advantageous in the case of a numbering machine, as illustrated in the figures, for which maintenance and/or replacement of the various numbering boxes on the numbering cylinders is a generally tedious and long process.

Advantageously, a quick-release mechanism (not shown), as such known in the art, might additionally be provided on the mobile carriage 4 in order to selectively take the second cylinder 15 away from its position in the printing unit 3 and move this cylinder 15 back, together with the carriage 4. By removing cylinder 15 from its mounting position, one provides a better access to the third cylinder 16 situated below and thereby ease maintenance operations (for instance when mounting or replacing numbering boxes on numbering cylinder 16).

With the presently proposed machine configuration, the inking devices can be removed from the forme cylinders thereby giving full and direct access to these cylinders. Previous numbering machines with fixedly located inking devices required that the inking devices be arranged in such a manner as to leave an open space for access to the numbering cylinders. This typically resulted in a machine configuration with inking devices arranged almost vertically with respect to the numbering cylinders so as to be able to get access to the numbering cylinder from one side of the machine (see for instance FIG. 1 of EP 0 061 795 or FIG. 1a of EP 0 167 196) and which accordingly limited the number of letterpress forme cylinders that could be disposed around the impression cylinder to typically two. Thanks to the independent drives of the inking devices and the movable inking carriage, it is now possible to build a machine with a greater number of forme cylinders around the impression cylinder. In this particular example where the impression cylinder 8 is a two-segment cylinder, it would previously have been practically impossible to dispose more than two letterpress forme cylinders around the impression cylinder (knowing that the available space around the impression cylinder is limited to less than 180° taking account of the necessary presence of the transfer cylinder 7 and the chain wheel drum 9), because the remaining space for access to the cylinders would have be very limited. With the machine configuration shown in FIGS. 1 and 2, the three letterpress forme cylinders 14, 15, 16 can advantageously be disposed around the impression cylinder 8 within an angular space of less than 180°.

It shall again be understood that the above-described embodiments of a numbering machine should not be regarded as being limitative. Various modifications and/or improvements may be made by those skilled in the art without departing from the scope of the annexed claims. In particular, as already mentioned, the invention is equally applicable to letterpress printing machines in general or printing machines which make use, at least partly, of at least one letterpress printing forme, as well as printing machines for printing onto webs of paper rather than sheets. It shall nevertheless be appreciated that this invention is particularly advantageous when implemented in numbering machines as described. Further, in the example of FIGS. 1 and 2, the first cylinder 14 can be omitted if necessary.

The invention claimed is:

1. A sheet-fed or web-fed letterpress printing machine comprising an impression cylinder, at least one inking device with an inking train comprising inking rollers, and at least one letterpress forme cylinder comprising raised printing portions that are inked by contact with specific inking rollers of the said at least one inking device that are placed in direct contact with said letterpress forme cylinder, wherein said letterpress forme cylinder is driven by first drive means, wherein said inking device is driven by second drive means, said second drive means being mechanically independent from said first drive means, and wherein a control unit is coupled to said second drive means for adjusting a circumferential speed of said specific inking rollers with respect to a circumferential speed of said letterpress forme cylinder and thereby adjust deposition of ink by said inking device on said letterpress forme cylinder, said control unit being designed to adjust the circumferential speed of said specific inking rollers with respect to the circumferential speed of said letterpress forme cylinder to counteract or exacerbate accumulation of ink on edges of the raised printing portions of said letterpress forme cylinder, the circumferential speed of the inking rollers that are placed in direct contact with said letterpress forme cylinder being adjusted by the control unit so as to be higher or lower than that of the letterpress forme cylinder.

2. The letterpress printing machine according to claim 1, wherein said at least one letterpress forme cylinder is a numbering cylinder for numbering printed sheets or webs.

3. The letterpress printing machine according to claim 1, wherein said second drive means drives at least one roller of said inking device through a gear drive arrangement.

4. The letterpress printing machine according to claim 1, wherein said second drive means comprise an electric motor.

5. The letterpress printing machine according to claim 1, wherein the said at least one inking device is mounted in a mobile carriage.

6. The letterpress printing machine according to claim 1, comprising a plurality of letterpress forme cylinders and a corresponding plurality of inking devices, each of said inking devices being driven by an independent drive means.

7. The letterpress printing machine according to claim 6, wherein the said inking devices are mounted in a common mobile carriage.

8. The letterpress printing machine according to claim 5, wherein said mobile carriage includes a quick-release mechanism for selectively removing one of said letterpress forme cylinder away from said impression cylinder.

9. The letterpress printing machine according to claim 6, comprising three letterpress forme cylinders disposed around the impression cylinder and wherein said impression cylinder is a two-segment cylinder with a diameter approximately twice that of the letterpress forme cylinders.

10. The letterpress printing machine according to claim 9, wherein said three letterpress forme cylinders are disposed around said impression cylinder within an angular space of less than 180°.

11. A process for providing and operating a sheet-fed or web-fed letterpress printing machine according to claim 1, said letterpress printing machine comprising an impression cylinder, at least one inking device with an inking train comprising inking rollers, and at least one letterpress forme cylinder comprising raised printing portions that are inked by contact with specific inking rollers of the said at least one inking device that are placed in direct contact with said letterpress forme cylinder, wherein said letterpress forme cylinder is driven by first drive means, and wherein said inking device is driven by second drive means, said second drive means being mechanically independent from said first drive means, said process comprising the step of adjusting a circumferential speed of said specific inking rollers with respect to a circumferential speed of said letterpress forme cylinder and thereby adjust deposition of ink by said inking device on said letterpress forme cylinder, the circumferential speed of said specific inking rollers being adjusted with respect to the circumferential speed of said letterpress forme cylinder to counteract or exacerbate accumulation of ink on edges of the raised printing portions of said letterpress forme cylinder, the circumferential speed of the inking rollers that are placed in direct contact with said letterpress forme cylinder being adjustable so as to be higher or lower than that of the letterpress forme cylinder.

12. The letterpress printing machine according to claim 7, wherein said mobile carriage includes a quick-release mechanism for selectively removing one of said letterpress forme cylinder away from said impression cylinder.

13. The letterpress printing machine according to claim 7, comprising three letterpress forme cylinders disposed around the impression cylinder and wherein said impression cylinder is a two-segment cylinder with a diameter approximately twice that of the letterpress forme cylinders.

14. A sheet-fed or web-fed letterpress printing machine comprising an impression cylinder, at least one inking device with an inking train comprising inking rollers, and at least one letterpress forme cylinder comprising raised printing portions that are inked by contact with specific inking rollers of the said at least one inking device that are placed in direct contact with said letterpress forme cylinder, wherein said letterpress forme cylinder is driven by first drive means, wherein said first drive means is a main drive of the machine and further drives the said impression cylinder, wherein said inking device is driven by second drive means, said second drive means being mechanically independent from said first drive means, and wherein a control unit is coupled to said second drive means for adjusting a circumferential speed of said specific inking rollers with respect to a circumferential speed of said letterpress forme cylinder and thereby adjust deposition of ink by said inking device on said letterpress forme cylinder, said control unit being designed to adjust the circumferential speed of said specific inking rollers with respect to the circumferential speed of said letterpress forme cylinder to counteract or exacerbate accumulation of ink on edges of the raised printing portions of said letterpress forme cylinder, the circumferential speed of the inking rollers that are placed in direct contact with said letterpress forme cylinder being adjusted by the control unit so as to be higher or lower than that of the letterpress forme cylinder.

15. The letterpress printing machine according to claim 14, wherein said at least one letterpress forme cylinder is a numbering cylinder for numbering printed sheets or webs.

16. The letterpress printing machine according to claim 14, wherein said second drive means drives at least one roller of said inking device through a gear drive arrangement.

17. The letterpress printing machine according to claim 14, wherein said second drive means comprise an electric motor.

18. The letterpress printing machine according to claim 14, wherein the said at least one inking device is mounted in a mobile carriage.

19. The letterpress printing machine according to claim 14, comprising a plurality of letterpress forme cylinders and a corresponding plurality of inking devices, each of said inking devices being driven by an independent drive means.

20. The letterpress printing machine according to claim 19, wherein the said inking devices are mounted in a common mobile carriage.

21. The letterpress printing machine according to claim 18, wherein said mobile carriage includes a quick-release mechanism for selectively removing one of said letterpress forme cylinder away from said impression cylinder.

22. The letterpress printing machine according to claim 19, comprising three letterpress forme cylinders disposed around the impression cylinder and wherein said impression cylinder is a two-segment cylinder with a diameter approximately twice that of the letterpress forme cylinders.

23. The letterpress printing machine according to claim 22, wherein said three letterpress forme cylinders are disposed around said impression cylinder within an angular space of less than 180°.

24. The letterpress printing machine according to claim 20, wherein said mobile carriage includes a quick-release mechanism for selectively removing one of said letterpress forme cylinder away from said impression cylinder.

25. The letterpress printing machine according to claim 20, comprising three letterpress forme cylinders disposed around the impression cylinder and wherein said impression cylinder is a two-segment cylinder with a diameter approximately twice that of the letterpress forme cylinders.

26. A process for providing and operating a sheet-fed or web-fed letterpress printing machine according to claim 14, said letterpress printing machine comprising an impression cylinder, at least one inking device with an inking train comprising inking rollers, and at least one letterpress forme cylinder comprising raised printing portions that are inked by contact with specific inking rollers of the said at least one inking device that are placed in direct contact with said letterpress forme cylinder, wherein said letterpress forme cylinder is driven by first drive means, wherein said first drive means is a main drive of the machine and further drives the said impression cylinder, and wherein said inking device is driven by second drive means, said second drive means being mechanically independent from said first drive means, said process comprising the step of adjusting a circumferential speed of said specific inking rollers with respect to a circumferential speed of said letterpress forme cylinder and thereby adjust deposition of ink by said inking device on said letterpress forme cylinder, the circumferential speed of said specific inking rollers being adjusted with respect to the circumferential speed of said letterpress forme cylinder to counteract or exacerbate accumulation of ink on edges of the raised printing portions of said letterpress forme cylinder, the circumferential speed of the inking rollers that are placed in direct contact with said letterpress forme cylinder being adjusted by the control unit so as to be higher or lower than that of the letterpress forme cylinder.

* * * * *

UNITED STATES PATENT AND TRADEMARK OFFICE

CERTIFICATE OF CORRECTION

PATENT NO. : 8,726,805 B2
APPLICATION NO. : 11/921492
DATED : May 20, 2014
INVENTOR(S) : Manfred Georg Stöhr et al.

It is certified that error appears in the above-identified patent and that said Letters Patent is hereby corrected as shown below:

On Title Page, item (57) Abstract, Line 4, please delete "form" and insert --forme--.

On Title Page, item (57) Abstract, Line 5, please delete "form" and insert --forme--.

On Title Page, item (57) Abstract, Line 13, please delete "form" and insert --forme--.

On Title Page, item (57) Abstract, Line 15, please delete "form" and insert --forme--.

On Title Page, item (57) Abstract, Line 16, please delete "form" and insert --forme--.

In the Specification

Column 3, Line 2, please delete "form" and insert --forme--.

Signed and Sealed this
Eighth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,726,805 B2
APPLICATION NO. : 11/921492
DATED : May 20, 2014
INVENTOR(S) : Manfred Georg Stöhr et al.

It is certified that error appears in the above-identified patent and that said Letters Patent is hereby corrected as shown below:

On Title Page, (73) Assignee, please delete "KBA-Giori S.A." and insert --KBA-NotaSys SA--.

Signed and Sealed this
Twelfth Day of January, 2016

Michelle K. Lee

Michelle K. Lee
*Director of the United States Patent and Trademark Office*